US006522085B2

(12) United States Patent
Popov et al.

(10) Patent No.: US 6,522,085 B2
(45) Date of Patent: Feb. 18, 2003

(54) HIGH LIGHT OUTPUT ELECTRODELESS FLUORESCENT CLOSED-LOOP LAMP

(75) Inventors: Oleg A. Popov, Needham, MA (US); Jagannathan Ravi, Bedford, MA (US); Robert Chandler, Lexington, MA (US); Edward Shapiro, Lexington, MA (US)

(73) Assignee: Matsushita Research and Development Laboratories Inc, Woburn, MA (US)

( * ) Notice: Subject to any disclaimer, the term of this patent is extended or adjusted under 35 U.S.C. 154(b) by 0 days.

(21) Appl. No.: 09/907,210

(22) Filed: Jul. 16, 2001

(65) Prior Publication Data

US 2003/0011322 A1 Jan. 16, 2003

(51) Int. Cl.[7] ..... H05B 41/16

(52) U.S. Cl. ..... 315/248; 315/344; 315/57; 315/62

(58) Field of Search ..... 315/248, 344, 315/328, 57, 62, 70, 71, 85, 39.55; 313/17, 493, 571, 572

(56) References Cited

U.S. PATENT DOCUMENTS

| | | | | |
|---|---|---|---|---|
| 3,500,188 A | | 3/1970 | Anderson | 315/57 |
| 3,987,334 A | | 10/1976 | Anderson | 315/57 |
| 3,987,335 A | | 10/1976 | Anderson | 315/62 |
| 4,017,764 A | | 4/1977 | Anderson | 315/248 |
| 4,187,447 A | | 2/1980 | Stout et al. | 315/85 |
| 4,266,166 A | * | 5/1981 | Proud et al. | 315/248 |
| 4,298,828 A | * | 11/1981 | Justice et al. | 315/248 |
| 5,130,912 A | * | 7/1992 | Friedrichs et al. | 313/493 |
| 5,539,283 A | * | 7/1996 | Piejak et al. | 313/492 |
| 5,834,905 A | | 9/1998 | Godyak et al. | 315/248 |
| 5,886,472 A | | 3/1999 | Alexzndrovich et al. | 315/85 |
| 6,288,490 B1 | * | 9/2001 | Popov | 313/607 |

OTHER PUBLICATIONS

John W. Saffer and Valery A. Godyak; The Development of Low Frequency, High Output Electrodeless Fluorescent LAmps; Winter 1999; Journal of the Illuminating Engineering Society

* cited by examiner

*Primary Examiner*—Haissa Philogene

(57) ABSTRACT

An electrodeless fluorescent lamp comprises a closed-loop ("tokamak") envelope, two ferrite cores, and an induction coil that is disposed on the envelope walls inside the closed-loop formed by the envelope. The envelope comprises two straight tubes of the same diameter. All coils' turns have essential the same length and are parallel to each other and to the closed-loop axis. Each ferrite core encircles a segment of each the coil's turn and one connecting tube. The lamp can be operated at driving frequencies of 100–600 kHz and lamp powers of 50–250 W. The ferrite core power losses were 6–8 W when the lamp was operated at a frequency of 200–300 kHz and lamp power of 140–150 W. The lamp light output was 12,500 lumen and luminous efficacy was 87 LPW.

21 Claims, 3 Drawing Sheets

HIGH LIGHT OUTPUT ELECTRODELESS FLUORESCENT CLOSED-LOOP LAMP

FIELD OF THE INVENTION

The present invention relates to electrodeless fluorescent lamps, and particularly to high light output closed-loop lamp utilizing the transformer coupling of the primary winding to the plasma current.

BACKGROUND OF THE INVENTION

The concept of a closed-loop electrodeless lamp was described by Anderson in U.S. Pat. No. 3,500,118. The lamp comprised a closed-loop tubular envelope, one or more ferrite cores encircling the tube and one or more turns wound on the core. The alternating voltage applied to the primary winding, $V_c$, induces an alternating magnetic field, $B_c$, in the core that in turn generates a closed loop alternating electric field, $E_{ind}$ in the envelope. The electric field, $E_{ind}$, generates in the envelope an inductively coupled discharge with the "closed-loop" current $I_{dis}$, that works as the secondary winding.

In U.S. Pat. No. 3,500,118, the lamp tube had a diameter about 3 cm and a path length of about 88 cm. The buffer gas, argon, was at the pressure between 1 and 5 torr. The lamp was operated at frequency, f>50 kHz, at power, $P_{lamp}$=30–40 W, and with the discharge current, $I_{dis}$=0.2–0.5 A. At such discharge conditions, the power losses, $P_{loss}$, in ferrite cores were relatively high (10–15 W) that resulted in low lamp power efficiency, $\eta=P_{pl}/P_{lamp}<80\%$.

A substantial improvement of the power efficiency and luminous efficacy of a closed-loop lamp was achieved by Godyak et al., U.S. Pat. No. 5,834,905. By increasing the discharge current, $I_{dis}$, from about 0.5 A to about 5 A and lamp power from about 40 W to about 150 W, Godyak et al. substantially reduced the ferrite core power losses, $P_{loss}$, from 11–18 W to 3–7 W. As a result, the power efficiency of the lamp operated at 150 W, was increased to 95% and the luminous efficacy was increased to 94 LPW. Both U.S. Pat. Nos. 5,834,905 and 3,500,118 employed the same coupling arrangement, an induction coil with several turns being wrapped around a ferrite core.

The ignition of an inductive discharge in the closed-loop envelope has to be preceded by the ignition of a capacitive discharge that required a high voltage of few hundred volts. The lamp described in U.S. Pat. No. 3,500,118 employed an additional coil and starting circuitry. In U.S. Pat. No. 5,834,905 patentees used a special "starting strip" attached to the envelope surface and starting circuitry.

In neither of U.S. Pat. Nos. 3,500,118 and 5,834,905, did patentees specify the type of wire used in coils nor count the power losses in the coil wire. In cases when the coil has a large number of turns, the wire resistance can constitute a substantial part of the total coil/core resistance and can contribute to the total coil/core power losses.

The lamp built in accordance with U.S. Pat. No. 5,834,905 employs inert buffer gases (Ar and Kr) at pressures below 500 mTorr, in particular, at 200 mTorr. This is supposedly optimum gas pressure for a tube having a diameter of 5 to 6 cm. While for lamps with smaller tube diameter, 2 to 4 cm, the optimum buffer gas pressure is expected to be higher than 500 mTorr.

An electrodeless lamp of the closed-loop shape operated at frequencies of 200–600 kHz and lamp power of 100–250 W but without a ferrite core was described in U.S. patent application of Popov, Ser. No. 09/256,137, filed Feb. 24, 1999, now U.S. Pat. No. 6,288,490 and owned by the same assignee as the present invention. The closed-loop, inductively coupled discharge was generated inside the envelope by the electric field, $E_{ind}$, induced in the envelope with the help of an induction coil only. No ferrite core was used. The coil was made from several turns positioned along the envelope walls, inside the closed-loop formed by the envelope. All turns were parallel to each other and to the closed-loop axis resulting in an axially uniform plasma and visible and UV radiations.

The coil of 10–14 turns consumed no more than 10 W at the lamp power of 150 W that resulted in high lamp power efficiency of 93%, and high luminous efficacy of 85 LPW. However, when the lamp was operated at a frequency, f<200 kHz, the power losses in the coil were high, >20 W.

SUMMARY OF THE INVENTION

According to the present invention a novel arrangement is disclosed that results in an efficient closed-loop electrodeless florescent lamp employing an induction coil and ferrite cores and has high power efficiency and luminous efficacy comparable to those described in U.S. Pat. No. 5,834,905 and U.S. patent application Ser. No. 09/256,137, now U.S. Pat. No. 6,288,490.

The invention involves an electrodeless fluorescent lamp formed from straight glass tubes each having approximately the same diameter. All tubes are sealed to each other, thereby forming a closed-loop envelope. The closed-loop envelope can also be made from a single tube bent into a circle or ellipse so two opposite tube's openings are sealed to each other. A protective coating is deposited on the vacuum side of the envelope and the phosphor coating is deposited on the protective coating.

A filling inert gas at the pressure of higher than 500 mTorr (argon, krypton or the like) and at least one of the vaporous metal such as mercury, are placed in the envelope.

A high frequency induction coil comprises of one or more turns up to 50 each having approximately the same diameter and length and disposed on the atmospheric side of the envelope's walls thereby forming the closed-loop. The loop is made from multiple strand wire (Litz wire). The number of strands vary from 40 to 600. The number of turns vary from 1 to 20. The gauge number can vary from #30 to 46. One or more ferrite cores up to four are disposed on the envelope so to encircle the tube and the adjacent segments of the coil's turns.

A high frequency (HF), 50–1000 kHz, power source is coupled to the induction coil via a matching network to ignite and maintain a HF discharge in the envelope. The closed-loop HF discharge generates an axially uniform plasma which in turn produces axially uniform visible and UV radiations.

An object of the present invention is to design an effective closed-loop electrodeless fluorescent lamp operating at frequencies 50–1000 kHz and HF power from 10 W to 5000 W.

Another object of the present invention is to design an assembly of the induction coil and ferrite core that has high core/coil inductance to operate at low frequency as low as 50 kHz.

Yet another object of the present invention is to design a coil that can start a capacitive discharge in the envelope without employing a special circuitry.

A further object of the present invention is to design a lamp where the buffer gas and mercury vapor pressures in the envelope were sufficient to provide high lamp luminous efficacy.

DESCRIPTION OF THE PREFERRED EMBODIMENTS

Figure 1:
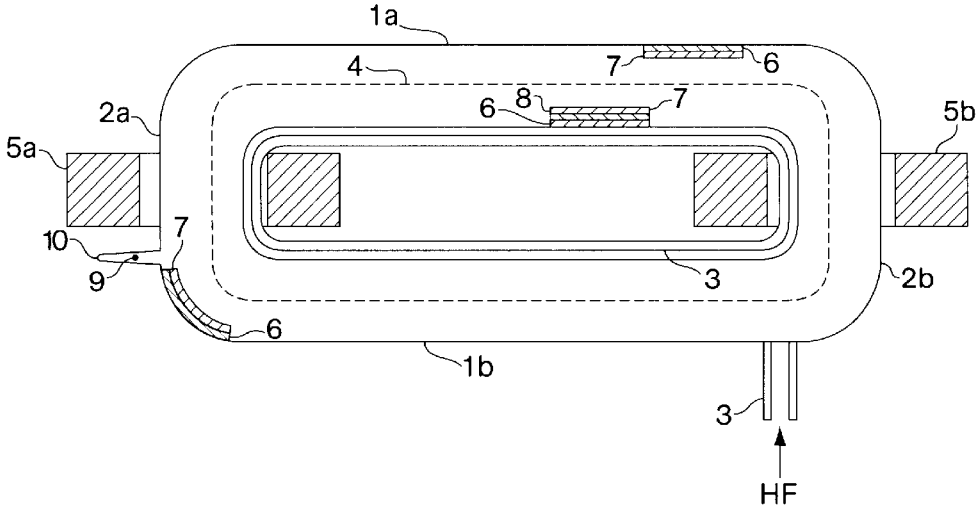
FIG. 1 is cross sectional view (with coatings enlarged) of the lamp according to the first embodiment of the present invention. $D_b$=45 mm; $H_b$=500 mm; two ferrite cores, Litz wire (465 strands) coil, N=2 turns. Argon pressure, p=550 mTorr.

Referring to FIG. 1, the lamp envelope has a rectangular shape and comprises two straight tubes, 1*a* and 1*b*, of the same diameter, D=44 mm, and length of 500 mm. Tubes 1*a* and 1*b*, are sealed to each other with two connecting straight tubes, 2*a* and 2*b*, of 32 mm diameter and 50 mm length.

A coil 3 made from Litz wire (465 strands of gauge #40) has two turns having substantially the same diameter and length. The coil 3 is positioned on the atmospheric side of the tubes 1*a* and 1*b*, inside the closed loop formed by the envelope. All turns are parallel to each other and to the plane of the envelope's closed-loop axis 4. The pitch between neighboring turns is close to zero. In other modifications, the pitch can be from 1 mm to 20 mm. Such an arrangement of the coil on the envelope walls minimizes the blocking of the light coming from the envelope and provides conditions for ignition of the capacitive discharge in the envelope. The wire of the coil 3 is coated with an insulating material so it can withstand high frequency voltage up to 1,500 V.

In other modifications, the wire is made from copper having gauge from #12 to #32. The wire is coated with thin silver layer and white teflon coating.

Two toroidal cores, 5*a* and 5*b*, are made from ferrite material (Mn Zn) and have an outer diameter of 74 mm and inner diameter of 37 mm. The width of each core is 2.6 mm so the cross section of the core is 2.3 $cm^2$. In other modifications the material can be NiZn. The core consists of two parts held together firmly with a clamp made from non-magnetic metal such as stainless steel, aluminum or the like.

Each core, 5*a* and 5*b*, is located on the two opposite sides of the envelope in a manner so each core, 5*a* and 5*b*, encircles one connecting tube, 2*a* and 2*b*. Each core also encircles the segment of each turn adjacent to the connecting tube.

The combination of the ferrite cores, 5*a* and 5*b*, and the induction coil 3 with turns disposed parallel to the axes of tubes 1*a*, 1*b*, 2*a*, 2*b*, is the novel arrangement that has new features that are absent in prior art. Indeed, the coil described in U.S. patent application Ser. No. 09/256,137 now U.S. Pat. No. 6,288,490 has many turns (N>10), needed to have high inductance, $L_c$>25 $\mu$H, and therefore be suitable in a lamp operated at frequencies of 300–400 kHz. The coil in the described embodiment has only 2 turns and therefore has the inductance of 2 $\mu$H that constitutes less than 2% from the combined coil/ferrite inductance of 145 $\mu$H. Thus, the inductance of the induction coil in the present invention, contrary to the coil described in U.S. patent application Ser. No. 09/256,137, now U.S. Pat. No. 6,288,490, does not contribute directly to the combined coil/ferrite inductance.

The differences between the present invention and the electrodeless fluorescent lamp described in U.S. Pat. No. 5,834,905 are as follows:

- the lamp of the present invention has only one induction coil that is "shared" by two (or more) ferrite cores, while in the prior art, each ferrite core "has its own" induction coil that is connected in series or in parallel with other coils. By reducing the number of coils to one, the lamp described in the present invention has simpler design and lower manufacturing cost.
- the coil in the lamp described in U.S. Pat. No. 5,834,905 is wrapped around the ferrite core while the coil in the present invention is not wrapped around the core but loosely encircles a portion of the ferrite core. Such a coil/ferrite core arrangement makes the manufacturing of the lamp easier and less expensive.
- in the U.S. Pat. No. 5,834,905, the magnetic field in each ferrite core is determined by the coil voltage on that core that could vary from each coil/ferrite assembly due to variation in the coil structure and size. If magnetic fields in ferrite cores are not the same, the electric fields maintaining the discharge in the lamp and ferrite power losses are also different that makes the lamp asymmetrical.

The lamp according to the present invention does not need a special ignition circuitry or a special wire strip since the induction coil in our invention works as the capacitive discharge ignitor as well.

The vacuum side of the walls of the straight and connecting tubes are coated with conventional protective coatings 6 formed of alumina or the like and conventional phosphor coating 7. A conventional reflecting coating 8 formed of aluminum or the like is deposited between the protective coating 8 and the phosphor coating 7 on the surface of the vacuum side of the portions of the tube covered with the ferrite cores.

The mercury pressure inside the envelope is controlled by the temperature of the cold spot 9 located in an exhaust tubulation 10. An HF power source supplies the voltage of the induction coil 3 via a matching network (not shown).

Figure 2A:
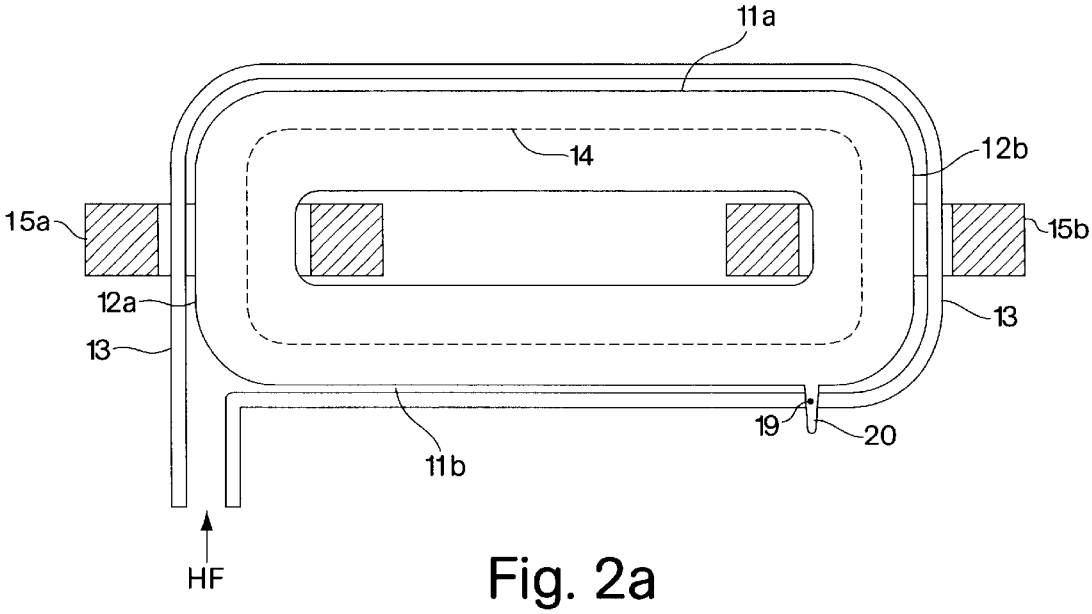
FIGS. 2*a* and 2*b* are cross sectional views of lamps according to the 2nd and the 3rd embodiments of the invention.

In a second embodiment of the present invention, the coil 13 is disposed on the outer side of the envelope encircling all tubes, 11*a*, 11*b*, 12*a*, 12*b* (FIG. 2*a*). As in the first embodiment, all turns are parallel to each other and to the plane of the axis of the closed-loop axis 14. Two ferrite cores, 15*a* and 15*b*, are positioned on the opposite sides of the envelope so as to encircle connecting tubes, 12*a* and 12*b*, and segments of the coil's turns adjacent to the connecting tubes.

Figure 2B:
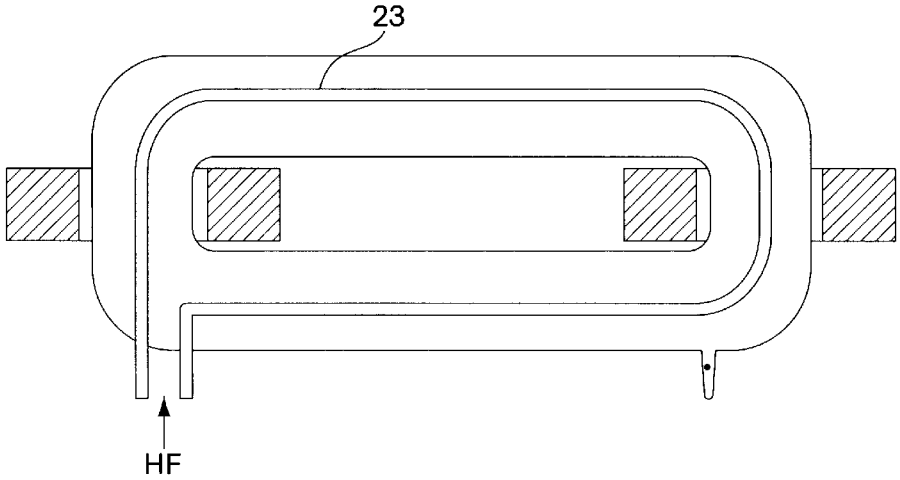

In a third embodiment, the coil 23 is disposed on the top or on the bottom of the envelope (FIG. 2*b*).

In other embodiments the coil's turns are made from copper wire coated with thin silver layer and insulated with a Teflon coating.

The lamp operates as follows. When the HF voltage on the coil reaches ≈300 V, a capacitive discharge is ignited in the envelope and maintained at the lamp power of 10–30 W. The increase of the coil voltage to about 400–500 V causes the transition of the capacitive discharge to the inductively coupled discharge.

The total lamp light output and efficacy depend on the ferrite core/coil power losses, $P_{loss}$. The smaller $P_{loss}$, the more the power is absorbed by the plasma, $P_{pl}$, and the higher the lamp power efficiency, $\eta=P_{pl}/P_{lamp}=P_{pl}/(P_{pl}+P_{loss})$. The measured coil/core power losses, $P_{loss}$, and the lamp power efficiency, $\eta$, are plotted as functions of the lamp power, $P_{lamp}$, in FIG. 3 for the lamp built in accordance with the first embodiment of the present invention (FIG. 1). The driving frequency was 300 kHz.

Figure 3:
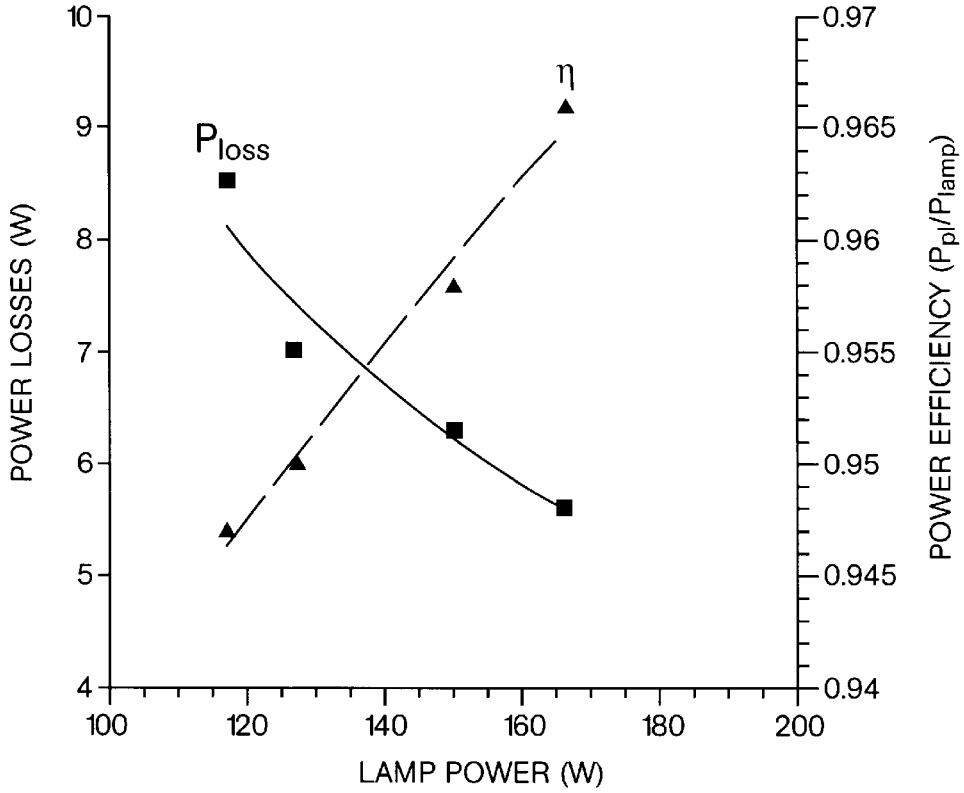
FIG. 3 is the graph showing the coil/core power losses, $P_{loss}$, and the power efficiency, $\eta=P_{pl}/P_{lamp}$, as functions of lamp power $P_{lamp}$. The driving frequency, f=300 kHz. Conditions and terms as in FIG. 1.

It is seen that the coil/ferrite power losses drops from ≃8 W at $P_{lamp}$=115 W to about 5.5 W at $P_{lamp}$=165 W. Due to very small characteristic resistance of Litz wire, about equal to $0.2\times10^{-4}$ Ohm/cm, the resistance of coil 3 is very small, $R_c$, is less than about 0.04 Ohm. At the frequency of 300 kHz and lamp power of 120–170 W, the coil current, $I_c$=1.8–2.5 A. So the coil power losses, $P_{coil}=(I_c)^2R_c$=0.2–0.3 W, that is less than 5% of the total coil/ferrite power losses of 5–8 W (FIG.3). Thus, more than 95% of the power losses are due to ferrite losses.

The lamp power efficiency, $\eta$, increases from 95% at $P_{lamp}$=120 W to 97% at $P_{lamp}$=170 W. These data of $P_{loss}$, and $\eta$ are very close to those in the "tokamak"-type lamp described in U.S. Pat. No. 5,834,905 that employed two multiple-turns coils each wrapped around the ferrite core.

Figure 4:
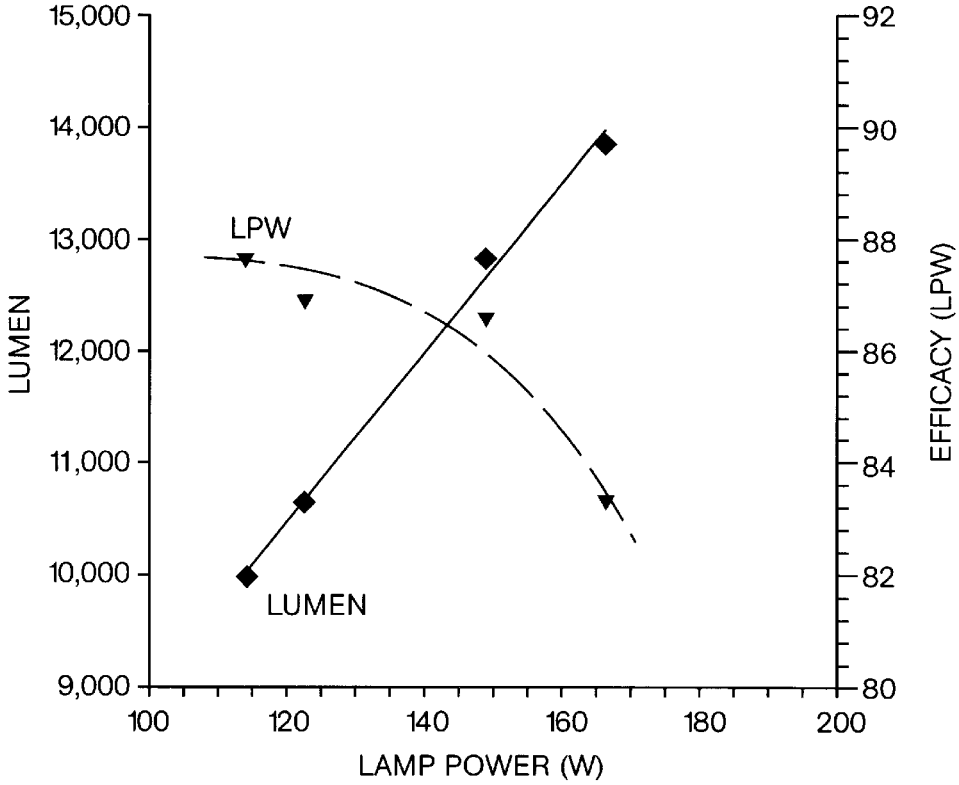
FIG. 4 is the graph showing the lamp light output (lumen) and the lamp efficacy, $\epsilon$, as functions of the lamp power, $P_{lamp}$. The driving frequency, f=300 kHz. Conditions and terms as in FIG. 1.

The lamp light output (lumen) and efficacy, $\epsilon$, as functions of the lamp power are plotted in FIG. 4 for the lamp operated at a frequency of 300 kHz. It is seen that light output increases with lamp HF power from 10,000 lumen at 114 W to 14,000 lumen at 166 W. The lamp efficacy is about equal to 87 LPW at $P_{lamp}$=110–150 W and then decreases as $P_{lamp}$ increases. The value of 87 LPW is slightly lower than that reported in the electrodeless lamp described in U.S. Pat. No. 5,834,905 (92 LPW). The difference in efficacy (about 5 LPW) can be attributed to the slightly larger tube diameter (5 cm) of the lamp used in U.S. Pat. No. 5,834,905.

It is apparent that modifications and changes can be made within the spirit and scope of the present invention, but it is our intention, however, to be limited only by the scope of the appended claims.

As our invention, we claim:

1. An electrodeless fluorescent lamp comprising:

a glass envelope made from at least one glass tube, the ends of said tube being sealed to form a closed-loop envelope with the closed-loop tube axis;

a vaporous metal selected from the group consisting of mercury, sodium, cadmium or the like the vapor pressure of said metal being controlled by the temperature of a cold spot (or amalgam temperature)

a filling of an inert gas at pressure higher than 500 mTorr;

a protective coating deposited on the vacuum side of said envelope walls and a phosphor coating deposited on said protective coating;

a reflecting coating deposited on portions of said connecting tubes;

an induction coil made from one or more turns, each turn having substantially the same length and diameter, said turns being disposed directly on the envelope wall and arranged parallel to the tube (closed-loop) axis and to each other and adjacent to said reflecting coating;

at least one ferrite core disposed on said tubes, each core encircling one of said tubes and one segment of said turns adjacent to said tube; thereby, providing the coupling of said coil to said tube;

a high frequency (HF) power source coupled to said induction coil to ignite and maintain an HF discharge in said envelope.

2. The lamp according to claim 1 wherein there are two straight tubes of the same diameter, said tubes being sealed to each other with two connecting straight tubes of essentially the same diameter forming the closed-loop envelope with the closed-loop tube axis.

3. An electrodeless fluorescent lamp as defined in claim 2 wherein said straight tubes have length from 5 cm to 200 cm.

4. An electrodeless fluorescent lamp as defined in claim 2 wherein said straight tube have diameter from 2 cm to 20 cm.

5. An electrodeless fluorescent lamp as defined in claim 2 wherein said connecting tubes has length from 1 cm to 50 cm.

6. An electrodeless fluorescent lamp as defined in claim 2 wherein said connecting tubes have diameter from 0.5 cm to 20 cm.

7. An electrodeless fluorescent lamp as defined in claim 1 wherein said coil has from 1 to 30 turns.

8. An electrodeless fluorescent lamp as defined in claim 7 wherein said coil is made from copper wire coated with thin silver coating and insulated with Teflon coating.

9. An electrodeless fluorescent lamp as defined in claim 8 wherein said wire has gauge number from 12 to 32.

10. An electrodeless fluorescent lamp as defined in claim 7 wherein said coil is made from multiple strands of Litz wire.

11. An electrodeless fluorescent lamp as defined in claim 10 wherein said Litz wire has from 20 to 600 strands.

12. An electrodeless florescent lamp as defined in claim 7 wherein said coil has a pitch, said being from 1 to 20 mm.

13. An electrodeless fluorescent lamp as defined in claim 1 wherein said turns are positioned inside the closed-loop formed by said envelope.

14. An electrodeless fluorescent lamp as defined in claim 1 wherein said turns are positioned on the top or bottom of said envelope.

15. An electrodeless fluorescent lamp as defined in claim 1 wherein said core is made from MnZn ferrite material.

16. An electrodeless fluorescent lamp as defined in claim 1 wherein said ferrite core is made from NiZn ferrite materials.

17. An electrodeless fluorescent lamp as defined in claim 1 wherein said core has inner diameter from 0.45 cm to 25 cm.

18. An electrodeless fluorescent lamp as defined in claim 1 wherein said core has outer diameter from 5 cm to 30 cm.

19. An electrodeless fluorescent lamp as defined in claim 1 wherein said ferrite core width from 1 cm to 10 cm.

20. An electrodeless fluorescent lamp as defined in claim 1 wherein said HF power frequency can be from 20 kHz to 20 MHz.

21. An electrodeless fluorescent lamp as defined in claim 1 wherein said HF power can be from 10 W to 5,000 W.

* * * * *